United States Patent [19]

Achelpohl et al.

[11] Patent Number: 4,726,169

[45] Date of Patent: Feb. 23, 1988

[54] PROCESS OF MANUFACTURING SACKS FROM SYNTHETIC THERMOPLASTIC MATERIAL

[75] Inventors: Fritz Achelpohl, Lengerich; Hermann Oelrich, Ladbergen, both of Fed. Rep. of Germany

[73] Assignee: Windmöller & Hölscher, Lengerich, Fed. Rep. of Germany

[21] Appl. No.: 824,372

[22] Filed: Jan. 23, 1986

[30] Foreign Application Priority Data

Jan. 23, 1985 [DE] Fed. Rep. of Germany ..... 3502151

[51] Int. Cl.[4] ..... B65B 9/02

[52] U.S. Cl. ..... 53/455; 53/449; 53/553; 493/198; 493/217; 493/933

[58] Field of Search ..... 493/217, 933, 198; 53/455, 449, 553, 554, 555

[56] References Cited

U.S. PATENT DOCUMENTS

| | | | |
|---|---|---|---|
| 2,257,823 | 10/1941 | Stokes | 493/217 X |
| 2,374,128 | 4/1945 | Pinckert | 493/217 X |
| 3,391,615 | 7/1968 | Lepisto | 493/217 X |
| 4,014,252 | 3/1977 | Saito | 493/217 |
| 4,337,058 | 6/1982 | Lerner | 493/198 X |
| 4,340,379 | 7/1982 | Williamson | 493/933 X |

FOREIGN PATENT DOCUMENTS

| | | |
|---|---|---|
| 1018714 | 10/1957 | Fed. Rep. of Germany . |
| 2707584 | 8/1978 | Fed. Rep. of Germany . |

*Primary Examiner*—James F. Coan

*Attorney, Agent, or Firm*—Fleit, Jacobson, Cohn & Price

[57] ABSTRACT

A process of manufacturing sacks from synthetic thermoplastic material. A tubular structure is formed from webs of plastic film in that the side portions are infolded and their overlapping margins are adhesively joined by an adhesive seam, tubular sections are severed from the tubular structure and the tubular sections are provided with bottom seam welds and are then filled and provided with top seam welds. The two plastic film webs are moved in unison, and cut sections of oriented plastic material are provided, which cut sections are shorter than the distance between the subsequently formed bottom and top seam welds as measured along the flattened sacks. The cut sections are introduced between the plastic film webs with such a spacing relative to each other that the spaces between the bottom and top seam welds are to be formed. The plastic film webs and the fabric sections are brought together and are laterally offset from each other. The exposed margins of the plastic film webs and of the cut sections are provided with coatings of hot-melt adhesive so that during the subsequent formation of the tubular film the mutually overlapping margins provided with coatings of hot-melt adhesive are adhesively joined. The tubular sections are severed transversely from the tubular film near the centers of the spaces between consecutive cut sections. The transversely extending bottom and top seam welds are formed only between the inner and outer tubular films.

7 Claims, 7 Drawing Figures

1
2
3
4
5
6
7
7a
7b
7c
7d
8
8a
8b
9
10
12
13
14
15
16
17
21
II
III
III
y

PROCESS OF MANUFACTURING SACKS FROM SYNTHETIC THERMOPLASTIC MATERIAL

BACKGROUND OF THE INVENTION

1. Field of the Invention

This invention relates to a process of manufacturing sacks from synthetic thermoplastic, and more particularly to a process for manufacturing plastic film sacks that have increased strength and increased resistance to puncture damage.

2. Description of the Prior Art

Plastic sacks are known where a tubular film is formed from a web of plastic film that has its side portions infolded and overlapped and in which the overlapped side portions are adhesively joined by an adhesive seam. Tubular sections are severed from the tubular film, and the tubular sections are provided with bottom seam welds, are filled, and are then provided with top seam welds to close the sack. Before the severed tubular sections are provided with the transversely extending bottom seam welds, they can be provided with gussets, if desired.

If the filled sacks are made from plastic film, they can be damaged as they are loaded, transported and placed into storage because the plastic film forming the walls of the sacks can very easily be torn when the sacks are subjected to rough handling. Damage to the sacks being handled may result in a loss of as much as 50% of their contents.

Other known sacks consist of tubular sections made from a web of oriented plastic material. Such sacks have a high strength so that they are not damaged even by rough handling or by impacts of pointed articles. But sacks made from webs of oriented plastic material have the disadvantage that they have poor welding gualities, so that considerable difficulties are involved in the making of the top and bottom seam welds.

It is an object of the present invention to provide a process for making plastic film sacks that have high strength and that can easily be provided with bottom and top seam welds.

SUMMARY OF THE INVENTION

In accordance with one aspect of the present invention, two plastic film webs are moved in unison, and sheet sections cut from a web of oriented plastic are provided, which sheet sections are shorter in length than the distance between the subseguently formed bottom and top seam welds when said distance is measured longitudinally along the flattened sacks. The sheet sections are introduced between the plastic film webs with such a spacing relative to each other that the spaces between adjacent sheet sections coincide with the regions in which the bottom and top seam welds are to be formed. The plastic film webs and the sheet sections are then brought together with a lateral offset, and the exposed margins of the plastic film webs and of the sheet sections are provided with coatings of a hot-melt adhesive so that during the subseguent formation of the tubular film the mutually overlapping margins provided with coatings of hot-melt adhesive are adhesively joined. Tubular sections are severed from the tubular film near the center of the spaces between the sheet sections, and the tubular sections are provided with transversely extending bottom and top seam welds only in the tubular film. It is apparent that the sacks made by the process in accordance with the invention have walls which consist of three plies and comprise outer and inner plastic webs and interposed reinforcing sheet sections of oriented plastic. The laminate which constitutes the sacks walls has a high density and also a high strength because the sheet sections are highly resistant to damage and to being torn. As the sheet sections are disposed outside the areas in which bottom and top seam welds are to be made, the seam welds can easily be formed. The loads to be taken up by the sacks are mainly applied to the side walls, which are reinforced by the sheet sections. For this reason the sack is not appreciably weakened by the fact that each sheet section terminates short of the bottom and top seam welds, which are formed only in the tubular film.

When the sacks made by the process according to the invention have been filled and provided with the top seam welds, they will resist even high loads and they will not be damaged even when they are repeatedly rehandled in transit and as they are placed into storage. Such sacks have a high resistance not only to being torn but also to being punctured because the sheet sections tend to return to their original positions after they have been contacted by pointed objects.

DESCRIPTION OF THE PREFERRED EMBODIMENTS

Figures 1, 2:
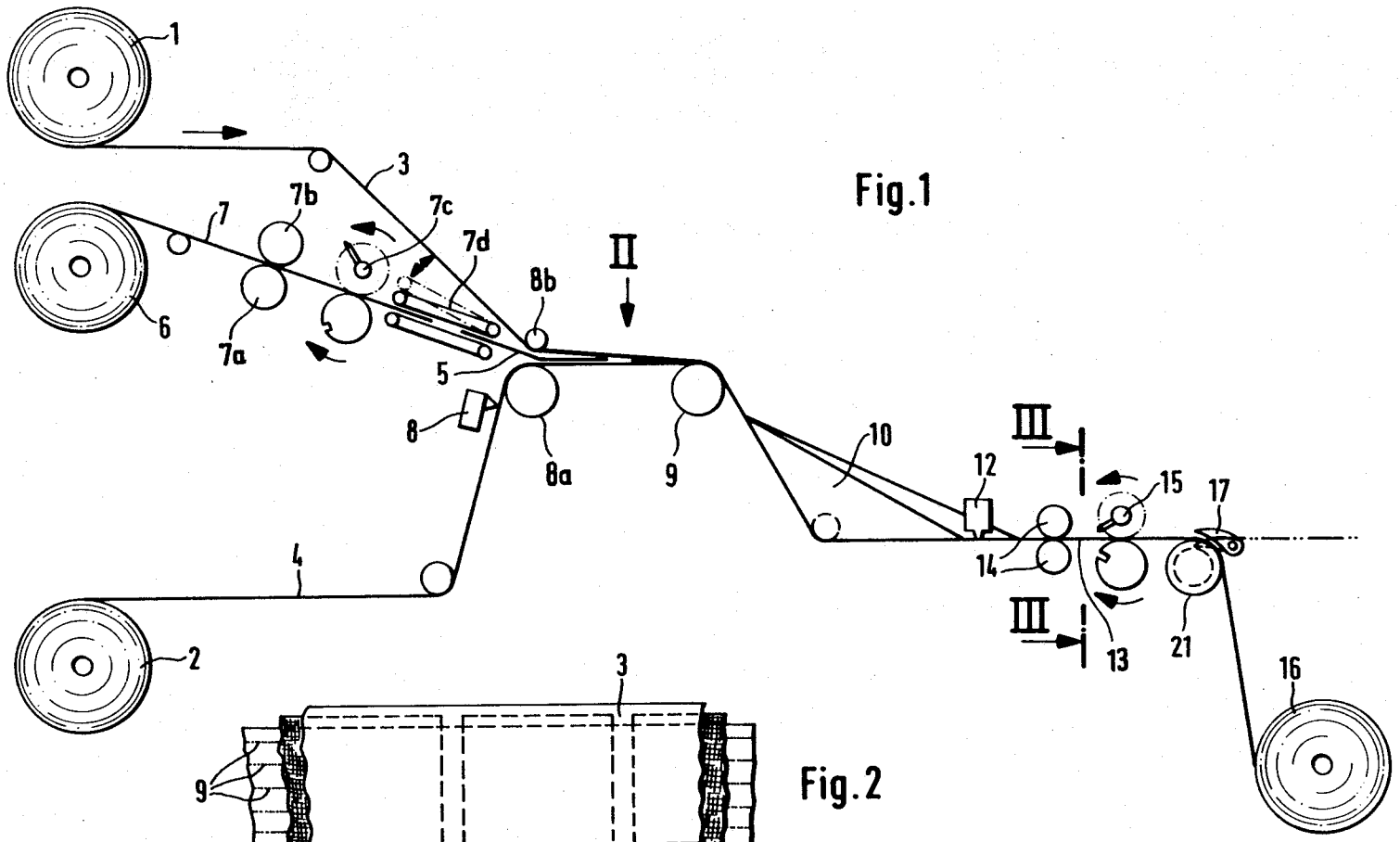
FIG. 1 is a schematic view showing the apparatus and the several operations performed in the manufacture of a three-ply web in accordance with the present invention.
FIG. 2 is a top plan view of a web in accordance with the present invention as viewed in the direction of the arrow II in FIG. 1.

Referring now to the drawings, and particularly to FIG. 1 thereof, there is shown a pair of rolls 1, 2, of synthetic thermoplastic film, that is unrolled from the rolls in the form of webs 3 and 4, respectively. The plastic film materials are of a type that can be easily heat sealed together to provide good seam welds, and can be such materials as polyethylene, polypropylene, or the like.

A third roll 6 of a stronger material, one that is more resistant to tearing and puncturing, such as, for example, an oriented plastic film material, is unrolled from roll 6 in the form of a web 7. Web 7 passes between a pair of feed rolls *7a*, *7b*, to a rotary cutter *7c*, which cuts individual sheets 5 from web 7. After being severed by cutter *7c*, the cut sheets 5 pass into a guide device *7d*, which, as shown, can be in the form of a pair of opposed, closely spaced endless belts that grip and carry consecutive sheets 5 in spaced relationship to a nip defined between a pair of guide rolls 8*a* and 8*b* and between respective webs 3 and 4.

Upstream of guide roll 8*a* and adjacent to web 4 is a glue applicator 8 that deposits a plurality of spaced, parallel, longitudinal strips 9 of hot melt adhesive (see FIG. 2) onto the upwardly facing surface of web 4, the adhesive strips serving to adhesively secure sheets 5 to the upwardly facing surface of web 4. Additionally, the adhesive strips 9 that lie in the spaces between consecutive sheets 5 permit webs 3 and 4 to be adhesively joined together at those positions.

The structure of the superposed webs after passage through guide rolls 8*a* and 8*b* is illustrated in FIG. 2, which is a view looking downwardly along arrow II of FIG. 1. As there shown, webs 3 and 4 are laterally offset from each other, and sheets 5 are laterally offset from and between each of webs 3 and 4, to define a three-ply structure wherein web 3 is the upper ply, web 4 is the lower ply, and sheets 5 constitute an interrupted intermediate ply, the respective plies being progressively laterally offset from each of the adjacent plies. Further, sheets 5, in addition to being offset laterally from each of webs 3 and 4, are also positioned so that their outer, longitudinal marginal edges are between the respective spaced outermost edges of each of webs 3 and 4.

As best seen in FIG. 2, sheets 5 are spaced from each other by the distance y, and define a discontinuous or interrupted intermediate ply. Because of the longitudinal spacing of respective sheets 5 from each other, the spacing y defines an overlap area, wherein webs 3 and 4 are in overlapping relationship, and conseguently webs 3 and 4 are adherently secured to each other by means of adhesive strips 9 that lie within the overlap area y.

Figure 3:
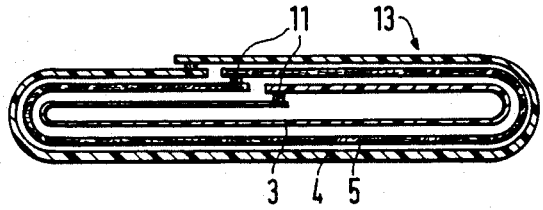
FIG. 3 is a cross-sectional view taken on line III—III of FIG. 1 and showing the three-ply web in tubular form.

Referring once again to FIG. 1, the respective superposed webs 3 and 4, and the intermediate sheets 5 define a composite structure that passes around guide roll 9 and through a folding means 10 that causes the respective outermost edges of the individual elements of the composite structure to be placed in overlapping relationship, as illustrated in FIG. 3. As a part of the folding means 10, a hot melt adhesive applicator 12 provides a plurality of adhesive strips 11, one of which is provided on an outermost edge of each of the respective webs 3 and 4, as well as on an outermost edge of the intermediate sheets 5, after which the overlapped edges are joined and the folded and adhered web passes through a pair of feed rollers 14 and is in the form illustrated in cross-section in FIG. 3. As therein shown, the respective outermost edges of web 3 are adhered together, the respective outermost edges of web 4 are adhered together, and the respective outermost edges of intermediate ply 5 are adhered together, each by respective adhesive strips 11, to provide a completed tubular structure 13.

Figure 4:
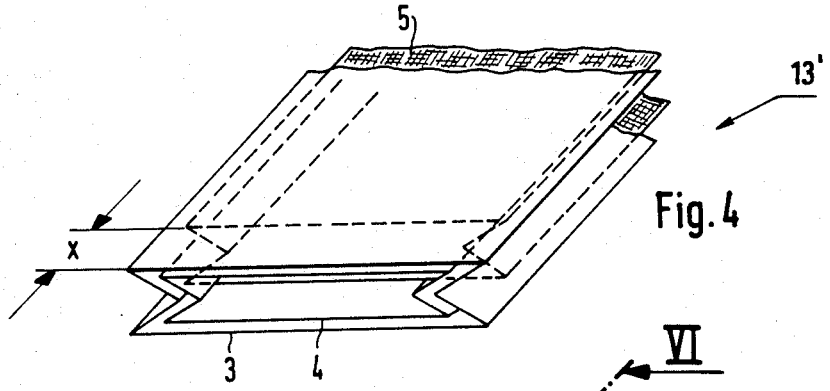
FIG. 4 is a perspective view showing a gusseted tubular web formed from the three-ply tubular web of FIG. 3.

After it is formed, tubular structure 13 can be cut into individual sections by cutter 15, the operation of cutter 15 being synchronized with the overlap area y between respective sections 5 so that the transverse cuts that are made by cutter 15 extend across the tube 13 and substantially in the middle of the overlap area y, and so that the respective cut sections each include an intermediate ply 5 that has its transverse edges spaced inwardly from the respective adjacent transverse edges of each of plies 3 and 4 by the distance x, as illustrated in FIG. 4. A suitable gusseting device (not shown), can be provided downstream of feed rollers 14 to form interiorly directed, marginal folds along the longitudinal edges of tube section 13', and thereby form longitudinal gussets along each side to provide the tube cross section shown in FIG. 4. The opposite end of tube section 13' is not shown in FIG. 4, and it is to be understood that at that opposite end not shown in FIG. 4 the same spacing relationship between the transverse end edges of the intermediate ply 5 and the respective transverse end edges of the inner and outer plies 3 and 4, respectively. is maintained so that the transverse edge of intermediate ply 5 is spaced inwardly of the transverse edges of plies 3 and 4 and that the spacing therebetween is the distance x.

If it is not desired that individual tube sections 13' be cut from tube 13, the cutter 15 can be rendered inoperative, and the tube will proceed past cutter 15 to a deflector 17 and around a guide roll 21 to be wound into a roll of tubing 16.

Figure 5:
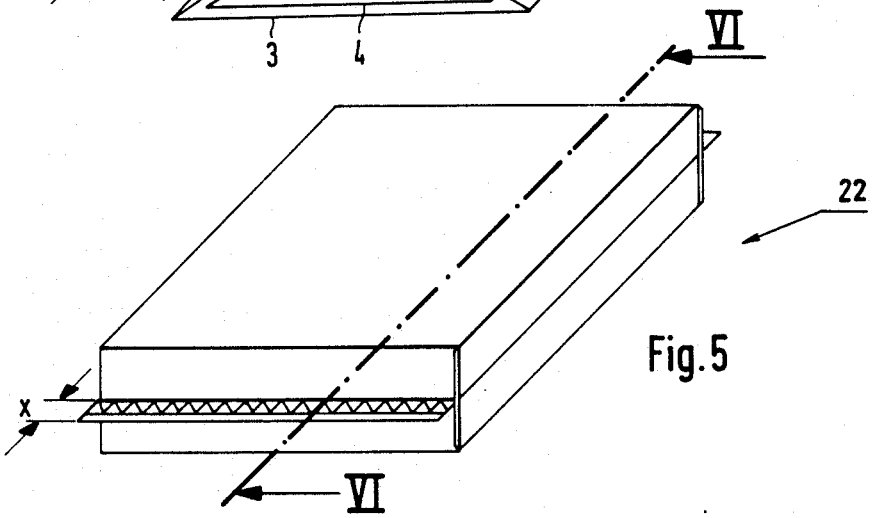
FIG. 5 shows a filled sack formed from a three-ply tubular web and having the ends defined by seam welds.
Figure 6:
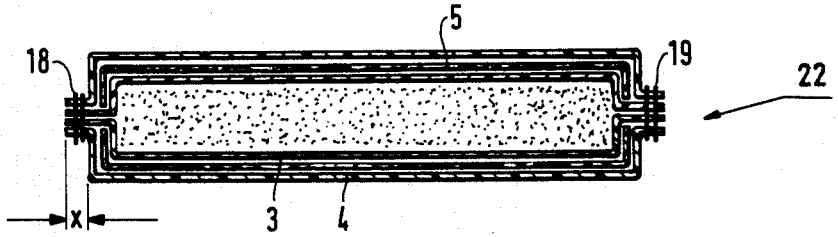
FIG. 6 is a cross-sectional view taken on line VI—VI in FIG. 5.

Referring now to FIGS. 5 and 6, FIG. 5 is a perspective view showing a completed sack 22 formed from a tube section 13' in accordance with the present invention, and from the original, flat configuration of tube section 13' shown in FIG. 4. As best seen in FIG. 6, which is a longitudinal cross section of a completed and filled sack 22, the sack includes transverse end seam welds 18 and 19, which are provided by joining together inner and outer plies 3 and 4, respectively. Further, intermediate ply 5 does not extend into the seam weld areas, and therefore it does not impair the formation or the strength of the respective seam welds. Again, the distance x represents the amount of direct overlap between plies 3 and 4, which overlap is free from any portion of intermediate ply 5. It will therefore be apparent that such a sack can be welded very effectively, and by virtue of the strong inner ply 5 it has a very high resistance to mechanical loads in the form of pressure and penetration loads. Sacks of the type illustrated generally have a capacity of about 25 to 50 kilograms, and can be used to package loose materials such as, for example, artificial fertilizer.

Figure 7:
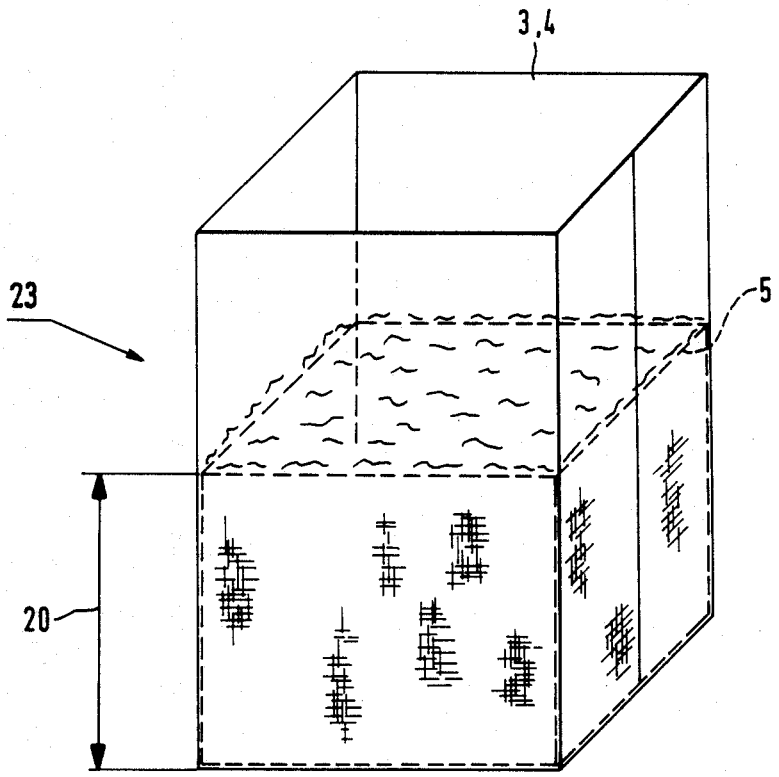
FIG. 7 is a perspective view showing a filled large sack formed from a three-ply tubular web before the top has been closed.

FIG. 7 differs from FIG. 5 in that it shows a large sack 23 having a capacity of about 1 to 2 tons. In sack 23 the longitudinal length of intermediate ply 5 corresponds with the height 20 to which the sack is to be filled, and the material that forms the bottom of the sack and that material reguired to close the sack involves only the extensions of plies 3 and 4 beyond intermediate ply 5. As is apparent from FIG. 7, the spacing between adjacent inserts 5, as represented by the distance y in FIG. 2, must be so selected that the extensions of plies 3 and 4 beyond the ends of intermediate ply 5 are sufficiently large so that an adeguate length of material remains for the formation of the bottom of the sack, which has already been formed in FIG. 7, as well as an adeguate amount of material at its top for covering the material in the filled sack. In the FIG. 7 embodiment the intermediate ply 5 serves, in essence, as an internal band to surround the product contained within the sack, and also to stiffen the side walls of the sack.

When the multi-ply tube 13 is not immediately severed into individual tube sections 13' but is wound onto a roll 16, as shown in FIG. 1. for shipment to another location, strips of flexible plastic film, or the like, are preferably placed transversely of tube 13 as it is being wound, to extend along and across the overlap areas y to compensate for the thinner web thickness at that part of the tube and thereby permit the tube to be wound into substantially cylindrical rolls.

Although particular embodiments of the invention have been illustrated and described, it will be apparent to those skilled in the art that various changes and modifications can be made without departing from the spirit of the present invention. It is therefore intended to cover in the appended claims all such changes and modifications that fall within the scope of the present invention.

What is claimed is:

1. A process of manufacturing tubular sacks from synthetic plastic material, said process comprising the steps of:

(a) providing first and second synthetic thermoplastic film webs each having two laterally spaced longitudinal edges;

(b) moving said first and second plastic film webs together in a common direction and in spaced, superposed relationship;

(c) providing sections of oriented plastic film having a predetermined longitudinal dimension and having two laterally spaced longitudinal marginal edges, said sections of oriented plastic film having a strength greater than a strength of said first and second film webs;

(d) introducing said sections of oriented film between said first and second film webs in longitudinally spaced relationship at a predetermined longitudinal spacing to provide intermediate sections between said webs;

(e) bringing said first and second film webs and said intermediate sections together in progressively laterally offset relationship to each other;

(f) applying a hot melt adhesive as a plurality o spaced, substantially parallel, longitudinal strips on an inwardly facing surface of one of said film webs before said film webs and said intermediate sections are brought together, to adhesively join together, said first and second webs in said intermediate sections and to adhesively join together said one of said film webs and said sheet sections;

(g) folding over at least one longitudinal marginal edge of each said first and second film webs and at least one longitudinal marginal edge of said intermediate sections into overlapping relationship with the respective other longitudinal marginal edge of each of said film webs and said sections; and (h) joining together said respective overlapping longitudinal marginal edges of said first and second webs and of said film sections to form a three-ply tubular structure having continuous inner and outer tubular plies and longitudinally spaced intermediate plies.

2. A process according to claim 1, including the step of severing said three-ply structure at transverse positions between adjacent intermediate plies to provide a tube section having a pair of longitudinally spaced opened ends defined by superposed inner and outer plies of plastic film.

3. A process according to claim 1, wherein the predetermined longitudinal dimension of said sheet sections egual the height of a side wall of a filled sack formed from said tubular structure.

4. A process according to claim 1, including the step of winding said three-ply tubular structure onto a roll for transit.

5. A process according to claim 4, including the step of applying flexible strips on said three-ply tubular structure at transverse positions between consecutive intermediate sections, said strips having a dimension in the longitudinal direction of said tubular structure substantially egual to said predetermined longitudinal spacing between said intermediate sections to compensate for the reduced thickness of the tubular structure between the intermediate sections and permit winding the tubular structure into a substantially cylindrical roll.

6. A process according to claim 1, including the step of forming a pair of opposed longitudinal gussets in said three-ply tubular structure.

7. A process according to claim 2, including the steps of:

(a) closing one end of said tube section by welding together adjacent transverse marginal edges of said inner and outer tubular plies at one end of said tubular structure to define a sack having one open end and having a first end seam;

(b) filling said sack with a product; and (c) closing the open end of said tubular structure by welding together adjacent transverse marginal edges of said inner and outer tubular plies at said open end to form a second end seam and close said sack.

* * * * *